US007228696B2

(12) United States Patent
Ambs et al.

(10) Patent No.: US 7,228,696 B2
(45) Date of Patent: Jun. 12, 2007

(54) HYBRID HEATING AND COOLING SYSTEM

(75) Inventors: Rex K. Ambs, Traverse City, MI (US); Thomas G. Kiessel, North Muskegon, MI (US); Dennis L. Weston, Northport, MI (US); James V. Holstine, Traverse City, MI (US)

(73) Assignee: Geofurnace Development Inc., Traverse City, MI (US)

( * ) Notice: Subject to any disclaimer, the term of this patent is extended or adjusted under 35 U.S.C. 154(b) by 186 days.

(21) Appl. No.: 11/167,426

(22) Filed: Jun. 27, 2005

(65) Prior Publication Data

US 2006/0288724 A1 Dec. 28, 2006

(51) Int. Cl.
*F25D 23/12* (2006.01)

(52) U.S. Cl. ..... 62/260

(58) Field of Classification Search ..... 62/160, 62/196.4, 200, 238.7, 278, 260, 324.1; 165/45
See application file for complete search history.

(56) References Cited

U.S. PATENT DOCUMENTS 5,388,419 A * 2/1995 Kaye ..... 62/160
5,461,876 A * 10/1995 Dressler ..... 62/160
5,564,282 A * 10/1996 Kaye ..... 62/160
5,706,888 A * 1/1998 Ambs et al. ..... 165/155
5,875,644 A * 3/1999 Ambs et al. ..... 62/324.6
5,937,665 A 8/1999 Kiessel et al.
5,983,660 A 11/1999 Kiessel et al.
6,167,715 B1 * 1/2001 Hebert ..... 62/260
7,004,246 B2 * 2/2006 Gavula ..... 165/299
7,017,650 B2 * 3/2006 Johnson et al. ..... 165/45
7,128,156 B2 * 10/2006 McClung, III ..... 166/302

FOREIGN PATENT DOCUMENTS

JP 57-55356 A * 4/1982

* cited by examiner

*Primary Examiner*—Mohammad M. Ali
(74) *Attorney, Agent, or Firm*—Warner Norcross & Judd LLP

(57) ABSTRACT

A heat and cooling system having an indoor air coil subcircuit, an outdoor air coil subcircuit, a geothermal subcircuit, and a control system for selectively operating the system in air-to-air heating, air-to-air cooling, geothermal heating, air-to-air defrost (optionally) and geothermal defrost modes. The various subcircuits may be connected to one another in parallel. The heating and cooling system may include a control system that permits refrigerant to be selectively routed through any two of the heat exchangers to provide the various modes of operation. In one embodiment, the control system may generally include a circuit having a single reversing valve, a plurality of check valves, a plurality of solenoid valves and a plurality of expansion devices.

26 Claims, 5 Drawing Sheets

HYBRID HEATING AND COOLING SYSTEM

BACKGROUND OF THE INVENTION

The present invention relates to heating and cooling apparatus, and more particularly to a heating and cooling system having geothermal and air-to-air subcircuits.

Air-to-air heat pumps have been in widespread use throughout the United States for many years. These units operate to exchange heat between outdoor air and inside air. For example, a conventional heat pump can operate in either a heating mode during which heat is drawn from the outdoor air and used in heating the inside of the building or in a cooling mode during which heat is drawn from inside the building and released into the outdoor air. Because these systems transfer rather than generate heat, they are generally more efficient than conventional heating and cooling systems.

Air-to-air heat pumps are available in a variety of designs. A typical air-to-air heat pump includes an outdoor air coil unit located outside of the building, an indoor air coil unit located within the building, a plurality of refrigerant lines for interconnecting the indoor and outdoor units, a compressor for moving refrigerant through the system and a control system for controlling operation of the heat pump. In the heating mode, liquid refrigerant enters the outdoor coil unit where it evaporates, thereby drawing heat from the external air into the refrigerant. The gas refrigerant flows from the outdoor coil unit through the refrigerant lines to the indoor coil unit. In the indoor coil unit, the gas refrigerant condenses back into a liquid, thereby releasing heat drawn from the outdoor air into the building. The liquid refrigerant then flows back to the outdoor coil unit to continue the cycle.

In the cooling mode, the process works essentially in reverse. Liquid refrigerant flows into the indoor coil unit where it evaporates to draw heat from the indoor air. The gas refrigerant flows through the refrigerant lines to the outdoor coil unit. In the outdoor coil unit, the refrigerant condenses, thereby releasing heat into the outdoor air. The liquid refrigerant then returns via the refrigerant lines to the indoor coil unit to continue the cycle.

Experience has revealed that when an air-to-air heat pump is operated in the heating mode at close to freezing temperatures, frost can form on the evaporator. This can significantly impair operation of the heat pump. Frost forms on the evaporator when the evaporator draws sufficient heat from the air surrounding the evaporator to freeze the moisture contained in the air. Frosting is typically not a problem at temperatures significantly above or below freezing because at higher temperatures there is enough heat in the air to prevent the moisture from freezing and at lower temperatures the moisture in the air is already frozen so it does not accumulate on the evaporator.

A number of methods have been developed to address the problem of frosting. For example, a number of conventional systems draw heat from inside the building to defrost the evaporator. These systems typically include an indoor coil that draws heat into the refrigerant from inside the building and then pumps the refrigerant through the external evaporator to remove the frost. This approach suffers in that it significantly reduces the efficiency of the heating system because heat is removed from the inside of building to defrost the evaporator. Drawing heat from inside the building can also generate an undesirable cold draft through the duct work. As another example, some systems include an electric heater located next to the evaporator. When the evaporator becomes frosted, the electric heater is turned on to remove the frost. This type of system is also inefficient because it requires operation of a separate electric heater.

One unique and particularly efficient solution to the problem of defrosting is disclosed in U.S. Pat. No. 5,983,660 to Kiessel et al. The system of U.S. Pat. No. 5,983,660 provides a heat pump system having a geothermal subcircuit to provide geothermal heat for defrosting the outdoor air coil. The system also includes "pump down" circuitry that can be selectively engaged to draw refrigerant out of the geothermal heat exchanger when it is not in use. This addresses issues that may arise as a result of refrigerant imbalance during the various modes of operation. Although this system is a marked improvement over many pre-existing heating and cooling systems, there continues to be a need for a more efficient and more adaptive heating and cooling system.

SUMMARY OF THE INVENTION

The aforementioned problems are overcome by the present invention which provides a hybrid heating and cooling system having an indoor heat exchanger (such as an indoor air coil), an outdoor air coil and a geothermal heat exchanger. The geothermal heat exchanger can be buried in the ground or submerged in a natural water source, such as a lake, river or underground well. The circuit includes control components that permit the system to operate in a variety of different modes including: (a) air-to-air heating, (b) air-to-air air conditioning, (c) geothermal defrost and (d) geothermal heating. The system may optionally include an air-to-air defrost mode.

In one embodiment, the indoor air coil subcircuit, outdoor air coil subcircuit and geothermal subcircuit are connected in parallel with one another by control components capable of selectively routing refrigerant through any two of the subcircuits to provide the distinct modes of operation discussed above. In this embodiment, the circuit isolates one of the indoor air coil, outdoor air coil or geothermal heat exchanger as appropriate during each mode of operation. The circuit may be configured so that the isolated heat exchange device is connected to the low pressure side of the compressor in each mode of operation. As a result, the compressor automatically pumps down (i.e. draws refrigerant out of) the isolated heat exchange device.

In one embodiment, the indoor air coil subcircuit is connected with the outdoor air coil subcircuit by a gas refrigerant line and a liquid refrigerant line. The system also includes a compressor or other refrigerant pump for moving refrigerant through the system. In this embodiment, the geothermal subcircuit includes a first refrigerant line connected to the liquid refrigerant line and a second refrigerant line connected to the compressor.

In one embodiment, the system includes a collection of valves that are selectively adjustable to route refrigerant between any two of the heat exchangers (i.e., the indoor air coil, the outdoor air coil and the geothermal heat exchanger).

The present invention provides a hybrid geothermal/air coil heating and cooling system that provides a high level of adaptability and improved efficiency over convention systems. The control system permits selective operation of any two heat exchangers in combination, thereby providing a highly adaptable system that can be controlled to take advantage of the most efficient heating or cooling combinations for varying circumstances. In select modes of operation, the geothermal heat exchanger can be used alternatively to provide energy for indoor heating and outside air coil defrosting. Additionally, the unique circuit of the present invention provides automatic pump down of the isolated heat exchange device during each mode of operation to address potential issues associated with refrigerant imbalance. Further, when geothermal operation is not most efficient, the system is capable of operating in an air-to-air mode utilizing the outdoor air coil. The circuit of the present invention is easily implemented with a small number of relatively inexpensive components. Accordingly, the equipment and installation costs of the system are relatively low.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
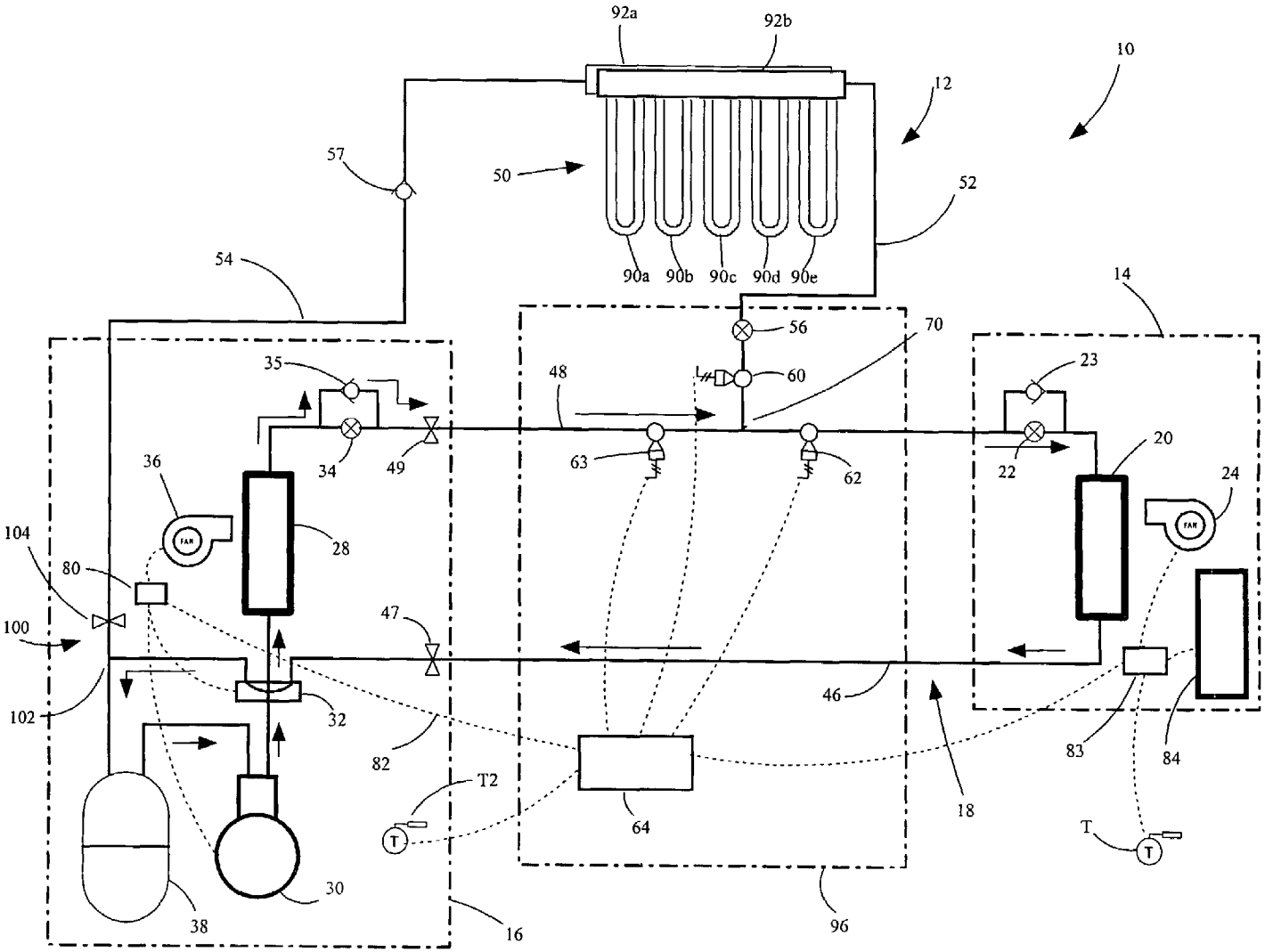
FIG. 1 is a schematic diagram of a heat pump circuit according to one embodiment of the present invention in the air-to-air cooling mode.

A heat and cooling system in accordance with an embodiment of the present invention is illustrated in FIG. 1 and generally designated 10. The system 10 generally includes an indoor air coil subcircuit 14, an outdoor air coil subcircuit 16 and a geothermal heat exchanger subcircuit 12. The system 10 includes a control system that permits any two of the three subcircuits to be selectively interconnected to provide heating or cooling as desired. The system 10 operates to either cool or heat a space by transferring heat between the indoor air, the outdoor air or a geothermal heat source. More specifically, in the cooling mode, the system 10 abstracts heat from the indoor air and releases it into the outdoor air, and in the heating modes, the system 10 abstracts heat from the outdoor air or the geothermal heat source and releases it into the indoor air. The system 10 is also capable of defrosting the outdoor air coil by transferring heat from the indoor air or the geothermal heat source to the outdoor air coil. More specifically, in the defrost modes, the system 10 abstracts heat from the indoor air or the geothermal heat source and releases it in the outdoor air coil. For purposes of disclosure, the present invention is described in connection with a heat pump circuit having a conventional indoor air coil unit 14 and a conventional outdoor air coil unit 16 interconnected by refrigerant lines 18. Except as described below, the operation and interrelationship of the components of the heat pump circuit are generally well known to those skilled in the field. Accordingly, the individual components will not be discussed in detail. However, a general summary of the components of the heat pump and their related functions will be provided. The present invention is well suited for use in connection with a wide variety of heat pump circuits having various designs and various capacities. The term "geothermal" is used herein to refer broadly to any of the range of systems designed to use natural elements as a heat sink, such as the ground, a lake or a well, and includes without limitation "geoexchange" and "ground source" systems.

As noted above, the system 10 includes an outdoor air coil subcircuit 16 to permit exchange of heat with the outdoor air. The design and configuration of the outdoor air coil subcircuit 16 may vary from application to application, but a variety of conventional outdoor air coil subcircuits are suitable for use in connection with the present invention. As shown in FIG. 1, the outdoor air coil unit 16 may be an air-to-air heat pump, such as Model No. CPRT30-1 from Goodman Manufacturing Company of Houston, Tex. This particular model includes an outdoor air coil 28 for exchanging heat with the outdoor air, a compressor 30 for circulating refrigerant through the system, a reversing valve 32 for controlling the direction of flow of refrigerant through the system, an expansion device 34 for creating a pressure differential within the circuit during the heating mode, and an outdoor fan 36 for moving outdoor air across the outdoor air coil 28. The expansion device 34 may include a bypass 35 which permits refrigerant to bypass the expansion device 34 during the air-to-air heating defrost mode, the cooling mode and the geothermal defrost mode. If desired, the expansion device 34 and associated bypass 35 may be incorporated into a single circuit component, such as a uni-directional flow restrictor, that meters the flow of refrigerant in one direction while permitting refrigerant to flow freely in the other. The outdoor air coil 16 of this embodiment may also include conventional valves 47 and 49 on the gas refrigerant line 46 and the liquid refrigerant lines 48, respectively. These valves 47 and 49 may be conventional king valves, if desired. The outdoor air coil unit 16 may also include other conventional components, such as an accumulator 38, a low pressure switch (not shown), and a high pressure switch (not shown). The reversing valve 32 may be replaced by other refrigerant control valves capable of performing a sufficiently similar function. The components of the outdoor air coil unit 16 are preferably, but not necessarily, contained within a single housing located outside of the building. The illustrated outdoor air coil subcircuit 16 is merely exemplary, and may be replaced by a variety of alternative outdoor air coil subcircuits. Although the outdoor air coil 16 of the illustrated embodiment includes a generally conventional air coil as its heat exchanger, the present invention is not limited to use with outdoor air coils. Rather, the present invention may include essentially any alternative outdoor heat exchanger. In the illustrated embodiment, the outdoor air coil unit 16 is configured to operate in a conventional manner in response to control signals received from an indoor thermostat T. If desired, a conventional oil separator can be added to the system 10 to address oil return issues.

The indoor air coil unit 14 operates to exchange heat with the indoor air. The design and configuration of the indoor air coil subcircuit 14 may vary from application to application, but a variety of conventional indoor air coil subcircuits are suitable for use in connection with the present invention. The indoor air coil unit 14, such as Model No. ARPT032-00C-1A from Goodman Manufacturing Company, Houston, Tex., includes an indoor air coil 20 for exchanging heat with the indoor air, an expansion device 22 for creating a pressure differential in the circuit during the cooling mode, and a blower 24 for moving air across the coil 20. The expansion device 22 may include a bypass 23 which permits refrigerant to bypass 23 the expansion device 22 during the air-to-air heating mode and the geothermal heating mode. If desired, the expansion device 22 and associated bypass 23 may be incorporated into a single circuit component, such as a unidirectional flow restrictor, that meters the flow of refrigerant in one direction while permitting refrigerant to flow freely in the other. These components are typically contained within a single housing 26 that is integrated with or connected to the building's duct work in a conventional manner. The indoor air coil unit 14 is interconnected with the outdoor air coil unit by a gas refrigerant line 46 extending between the indoor air coil 20 and the reversing valve 32, and a liquid refrigerant line 48 extending between the outdoor air coil 28 and the indoor air coil 20. The refrigerant lines 46 and 48 are generally conventional and may be conventional copper tubing. The diameter of the refrigerant line will vary from application to application depending on the capacity and design of the heat pump circuit and the type of refrigerant used in the circuit. However, in this embodiment, the liquid refrigerant line 48 is three-eighths of an inch in diameter and the gas refrigerant line 46 is three-fourths of an inch in diameter. Although the indoor coil unit 14 is described in connection with an indoor air coil 16, the system 10 may include an indoor unit with other types of heat exchange devices. For example, the indoor unit may include a conventional refrigerant-to-water heat exchanger (not shown). In this example, the indoor heat exchanger (not shown) may transfer heat between the refrigerant and an indoor heat transfer medium (e.g. water) that is used to operate a generally conventional radiant heating and cooling system, such as a radiant floor heating system.

The geothermal subcircuit 12 is connected to the heat pump circuit 10 in parallel as shown in FIG. 1, and includes a geothermal heat exchanger 50, a refrigerant line 52 extending between the heat exchanger 50 and the liquid refrigerant line 48, a refrigerant line 54 extending between the heat exchanger 50 and the compressor 30, an expansion device 56 (such as a fixed orifice) installed in refrigerant line 52 for creating a pressure differential in the circuit during the geothermal heating mode and the geothermal defrost mode, a check valve 57 installed in refrigerant line 54 to prevent refrigerant from flowing backwards into the heat exchanger 50 from the compressor 30 or the accumulator 38, a plurality of solenoid valves 60, 62 and 63 that control the flow of refrigerant through the various heat exchangers 20, 28 and 50. With the exception of the heat exchanger 50, the components of the geothermal subcircuit 12 may be contained within a single housing 96. If desired, check valve 57 may be installed within the housing of the outdoor air coil unit 16. In many applications, the system 10 will operate properly without check valve 57. Accordingly, check valve 57 is optional for many applications.

The present invention is well suited for use with a wide variety of conventional geothermal heat exchangers. However, in the illustrated embodiment, the heat exchanger 50 is designed for use with the matched indoor air coil unit and outdoor air coil unit combination described above, which is a two and one-half ton unit providing approximately 30,000 BTUs. The heat exchanger 50 includes a plurality of loops 90*a–e* interconnected with a pair of conventional manifolds 92*a–b*. Each loop 90*a–e* includes a generally U-shaped section of conventional copper tubing having a diameter of three-eighths of an inch and a length of approximately 120 feet (overall loop length of approximately 60 feet). The number of loops and the diameter and length of each loop will vary from application to application depending on a variety of factors, including without limitation the volume of heat exchange desired, the type of refrigerant used in the circuit, the capacity of the system, the pressure differential in the circuit, the climate in which the system is installed, and the makeup of the geothermal heat source. As a general rule, the heat exchanger 50 will include three loops for each ton of capacity. This rule is not absolute and the ratio of loops to capacity may vary. The distribution manifold 92*a* interconnects the input end of each loop 90*a–c* with the refrigerant line 52. The output manifold 92*b* interconnects the output end of each loop 90*a–e* with the refrigerant line 54. This permits refrigerant to flow through the loops 90*a–e* in parallel. Although the geothermal subcircuit 12 is described in connection with a refrigerant-based heat exchanger 50, the geothermal subcircuit 12 may include other types of heat exchangers. For example, the geothermal subcircuit 12 may include a generally conventional refrigerant-to-water heat exchanger (not shown). With this type of alternative heat exchanger, the geothermal subcircuit 12 includes a separate circuit that circulates water (or other heat transfer fluid) through one or more loops (not shown) disposed in the geothermal heat source. Typically, the water is circulated by a conventional circulating pump (not shown) and the loops are manufactured from conventional polyethylene tubing (or other conventional tubing). Heat may be exchanged between the segregated water and refrigerant circuits using essentially any type of heat exchanger, including a generally conventional coaxial heat exchanger in which the water circuit extends coaxially through a portion of the refrigerant circuit.

The heat pump circuit 10 also includes a control mechanism 64 for controlling the operation of the solenoid valves 60, 62 and 63, and other elements of the circuit 10. The control mechanism 64 may be a conventional electromechanical control system that receives input from an indoor thermostat T (or the indoor controller 83), the outdoor controller 80, an outdoor thermostat T2, and, if desired, other inputs that might affect operation of the system 10.

Installation and Operation

The indoor air coil unit 14 and outdoor air coil unit 16 are installed in a conventional manner using conventional techniques and apparatus. The indoor and outdoor air coil units may be purchased as pre-assembled units from any of a variety of well known suppliers. Alternatively, the units can be assembled from the components described above. In either event, the indoor and outdoor units of the illustrated embodiment are interconnected by liquid refrigerant line 48 and gas refrigerant line 46 as described above, and the reversing valve 32 (or other refrigerant control valve) is operatively connected to the outdoor controller 80 (as described below) using conventional techniques and apparatus.

The geothermal subcircuit 12 can be installed during initial installation of the heat pump circuit or it can be retrofit to an existing heat pump circuit. In retrofit applications, the indoor air coil unit 14 and the outdoor air coil unit 16 may be specifically pre-configured to provide easy retrofit of the geothermal subcircuit 12, for example, by including the necessary fittings, valves, etc. In one embodiment, the outdoor air coil 16' may include a geothermal upgrade port 100 to permit the geothermal subcircuit 12 to be easily connected to the outdoor air coil unit 16' (See FIG. 6) when desired without the need to remove or reclaim refrigerant from the circuit. In this embodiment, the geothermal upgrade port 100 is disposed between the refrigerant control valve (e.g. the reversing valve 32) and the compressor 30 on the low pressure or suction side. The geothermal upgrade port 100 may be located upstream from the accumulator 38, but it may alternatively be located downstream from the accumulator 38, if desired. The geothermal upgrade port 100 includes a splitter 102, such as a T-fitting or a Y-fitting, or other component that provides a way for connecting the refrigerant line 54 from the geothermal subcircuit 12 in a way that provides adequate refrigerant flow for proper operation of the geothermal subcircuit 12. The splitter 102 may be incorporated into one of the components of the outdoor air coil unit 16, such as the accumulator 38 or the compressor 30. The geothermal upgrade port 100 also includes a valve 104 that is operable to selectively open and close the port. The valve 104 may be essentially type of valve, such as a ball valve or a king valve. The splitter 102 and valve 104 may be separate components or may be integrated into a single component. The geothermal upgrade port 100 may be positioned so that it is accessible without opening the housing of the outdoor air coil unit 16. With this alternative embodiment, the geothermal subcircuit 12 is retrofitted to the system 10 by attaching refrigerant line 54 to the outdoor air coil unit 16' and attaching refrigerant line 52 to liquid refrigerant line 48. As a result of geothermal upgrade port 100, refrigerant line 54 can be easily connected to the outdoor air coil unit 16,' for example, by soldering, brazing or other otherwise connecting the line 54 directly to the geothermal upgrade port 100 while the valve 104 is closed. The closed valve 104 permits this connection to be made without the need for removing refrigerant from the outdoor air coil unit 16'. Once the geothermal subcircuit 12 is fully installed, the valve 104 can be opened to provide a flow path between the geothermal subcircuit 12 and the outdoor air coil unit 16. In most applications, it will be desirable to remove refrigerant from the liquid refrigerant line 48, indoor heat exchanger unit 14 and gas refrigerant line 46 before connecting refrigerant line 52 to liquid refrigerant line 48. If the refrigerant is not removed, it may spill or otherwise complicate the installation process. To remove refrigerant, the valve 49 located along the liquid refrigerant line 48 of the outdoor air coil unit 16' is closed and the compressor 30 is operated to withdraw refrigerant from the gas refrigerant line 46, the indoor heat exchanger unit 14 and the liquid refrigerant line 48. Once the refrigerant is sufficiently pumped down, the compressor 30 is disengaged and the valve 47 located along the gas refrigerant line 46 of the outdoor air coil unit 16' is closed. A conventional reclamation unit may be attached to the system 10 in a conventional manner to reclaim any remaining refrigerant located in the gas refrigerant line 46, the indoor heat exchanger unit 14 and the liquid refrigerant line 48. The liquid refrigerant line 48 can then be cut as necessary to connect refrigerant line 52 and to install the remaining necessary components, such as valves 62 and 63. Once the refrigerant lines 52 and 54 and related components are attached, the valve 104 in the geothermal upgrade port 100 and valves 47 and 49 can be opened to bring the geothermal subcircuit 12 into full communication with the remainder of the system 10. If desired, the valves 60, 62 and 63, expansion device 56 and/or control mechanism 64 may be housed within the housing of the outdoor air coil unit 16.

The heat exchanger 50 may be buried in the ground or submerged in a river, lake, well or other body of water, and then interconnected with the heat pump circuit by refrigerant lines 52 and 54. Typically, the heat exchanger will be buried in the ground. In such cases, the loops 90*a–c* can be buried collectively in a single bore or individually buried in separate bores. In this embodiment, refrigerant line 52 is connected at one end to the distribution manifold 92*a* and at the other end to the liquid refrigerant line 48 by a conventional "T" joint 70. Similarly, refrigerant line 54 of this embodiment is connected at one end to the output manifold 92*b* and at the other end to the compressor 30 by a conventional "T" joint 72. In the illustrated embodiment, the refrigerant line 54 is connected to the compressor 30 upstream from the accumulator 38. The solenoid valve 60 and expansion device 56 are installed in refrigerant line 52 while the optional check valve 57 is installed in refrigerant line 54 (if included). The solenoid valve 62 is installed in the liquid refrigerant line 48 between the indoor air coil unit 14 and the "T" joint 70. The solenoid valve 63 is installed in the liquid refrigerant line 48 between the outdoor air coil unit 16 and the "T" joint 70. The solenoid valves 60, 62 and 63 are operatively connected to the control mechanism 64 using conventional techniques and apparatus.

Figure 2:
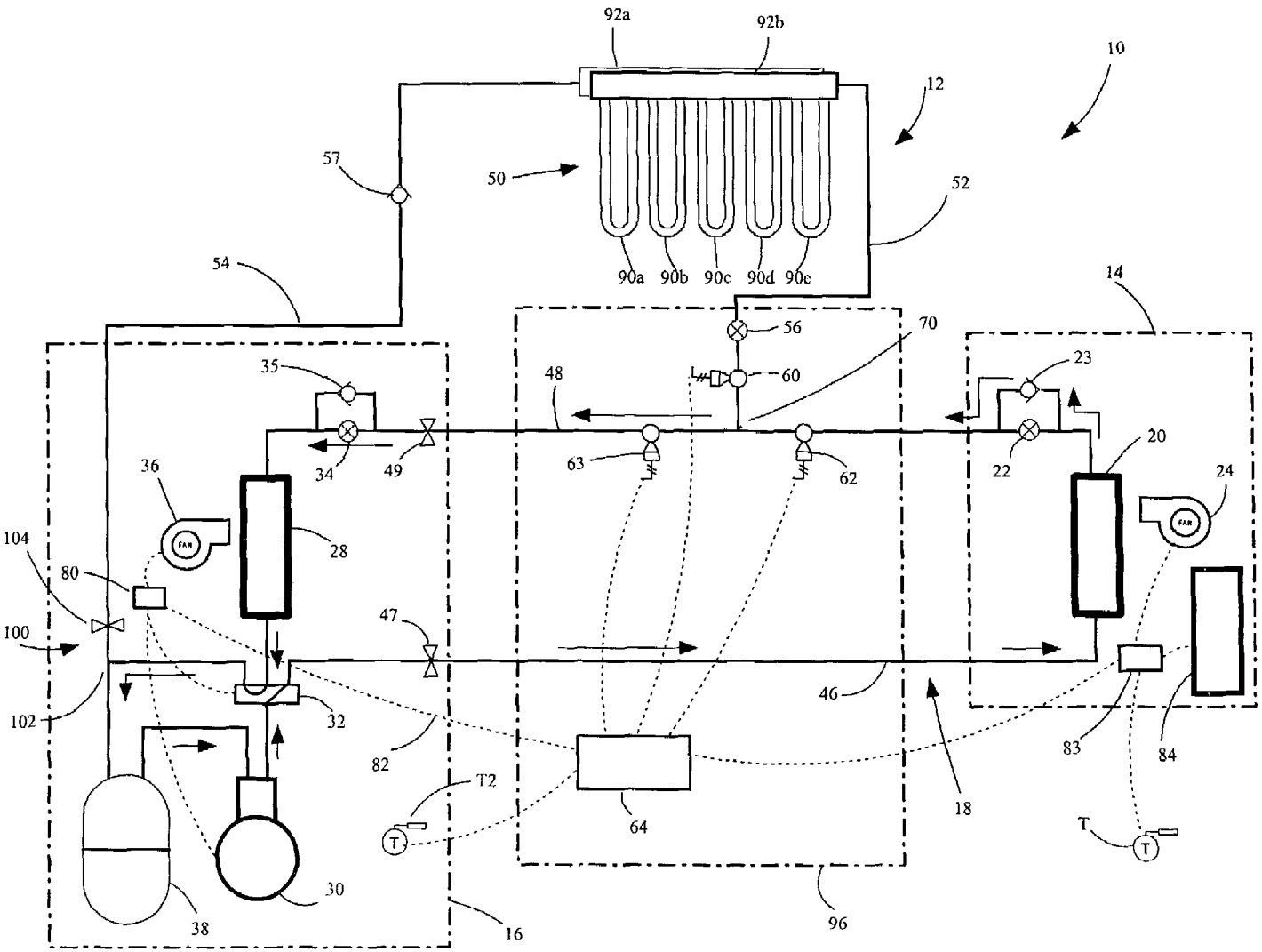
FIG. 2 is a schematic diagram of a heat pump circuit in the air-to-air heating mode.
Figure 3:
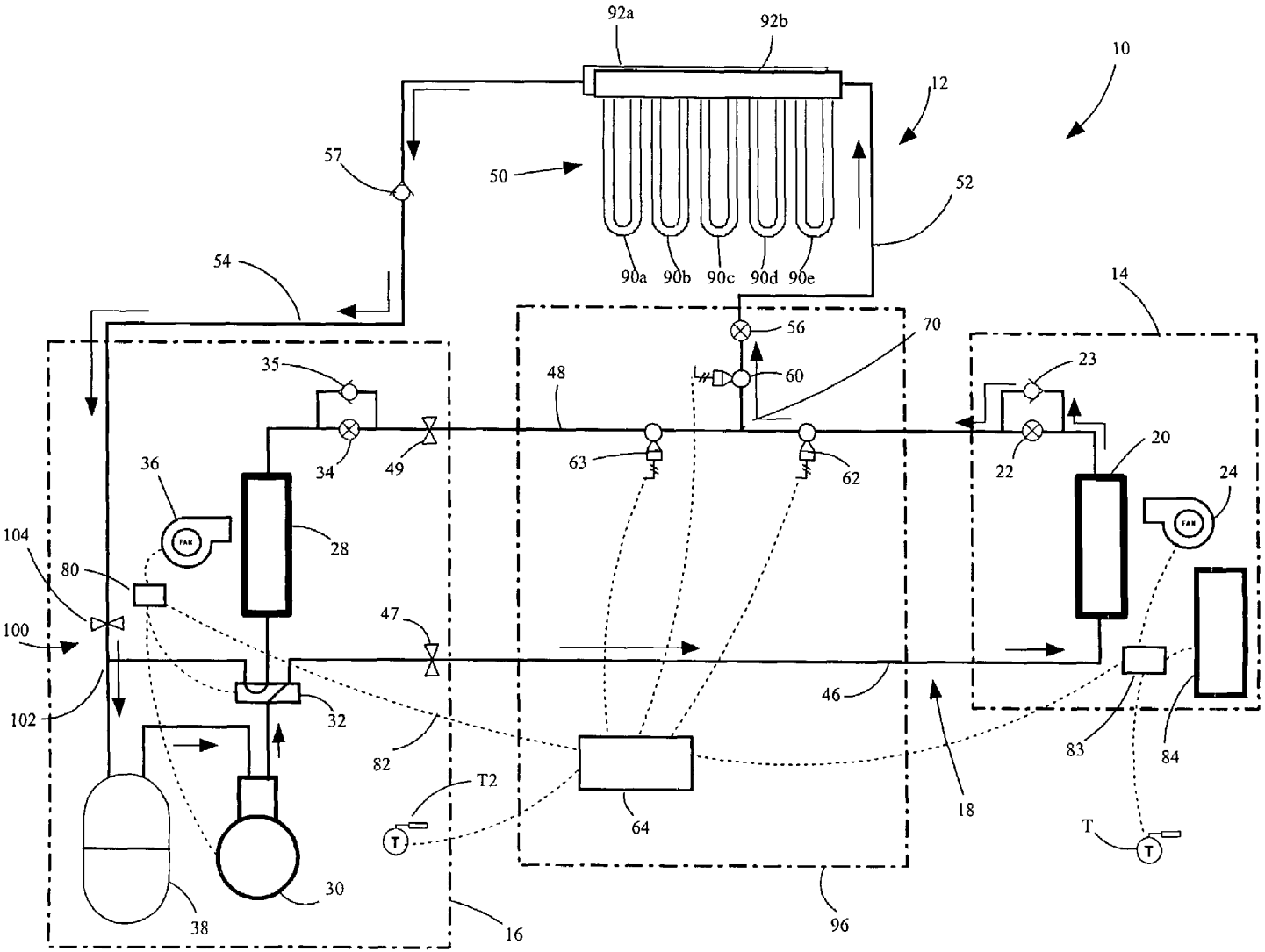
FIG. 3 is a schematic diagram of a heat pump circuit in the geothermal heating mode.
Figure 4:
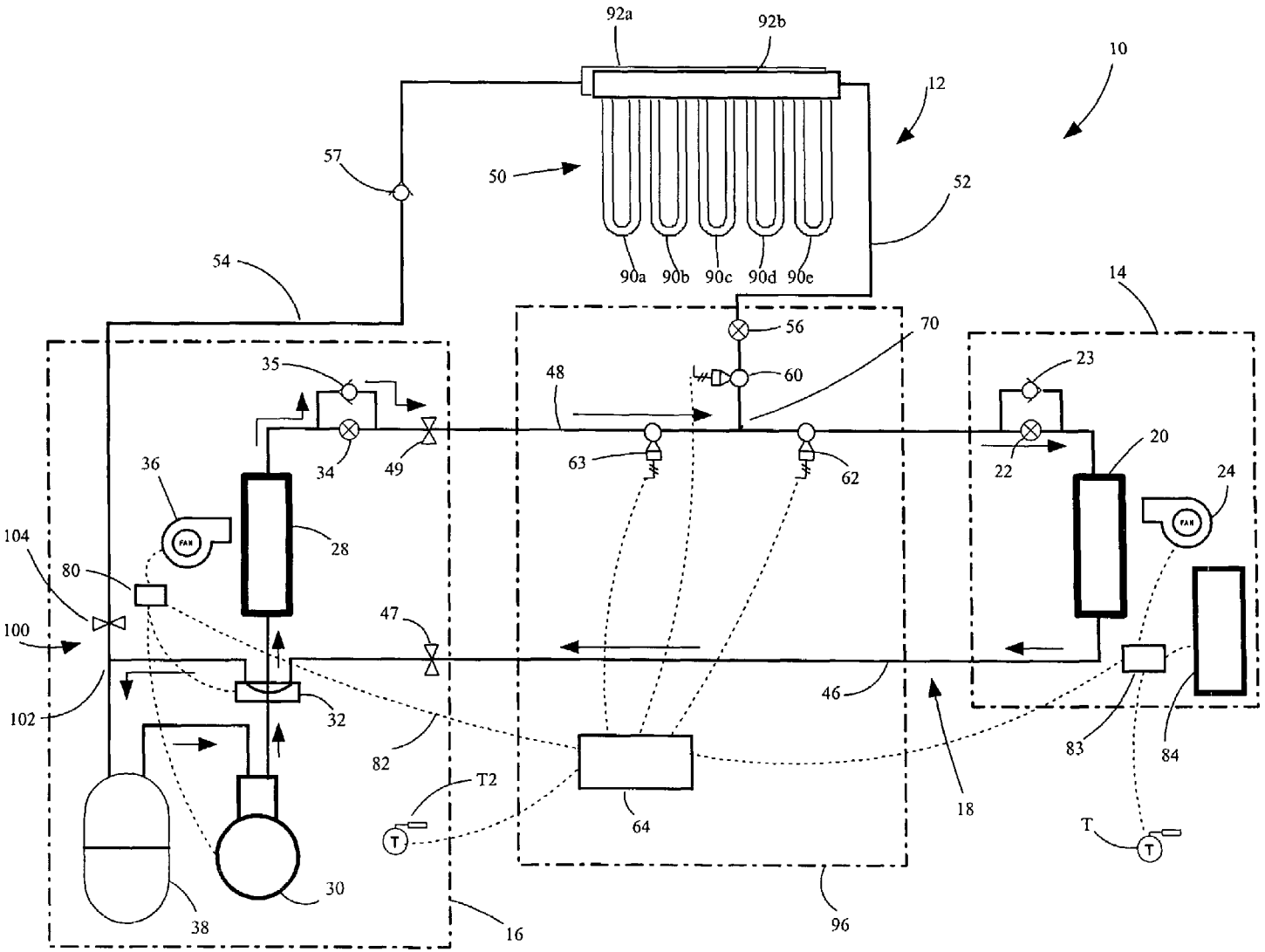
FIG. 4 is a schematic diagram of a heat pump circuit in the air-to-air defrost mode.
Figure 5:
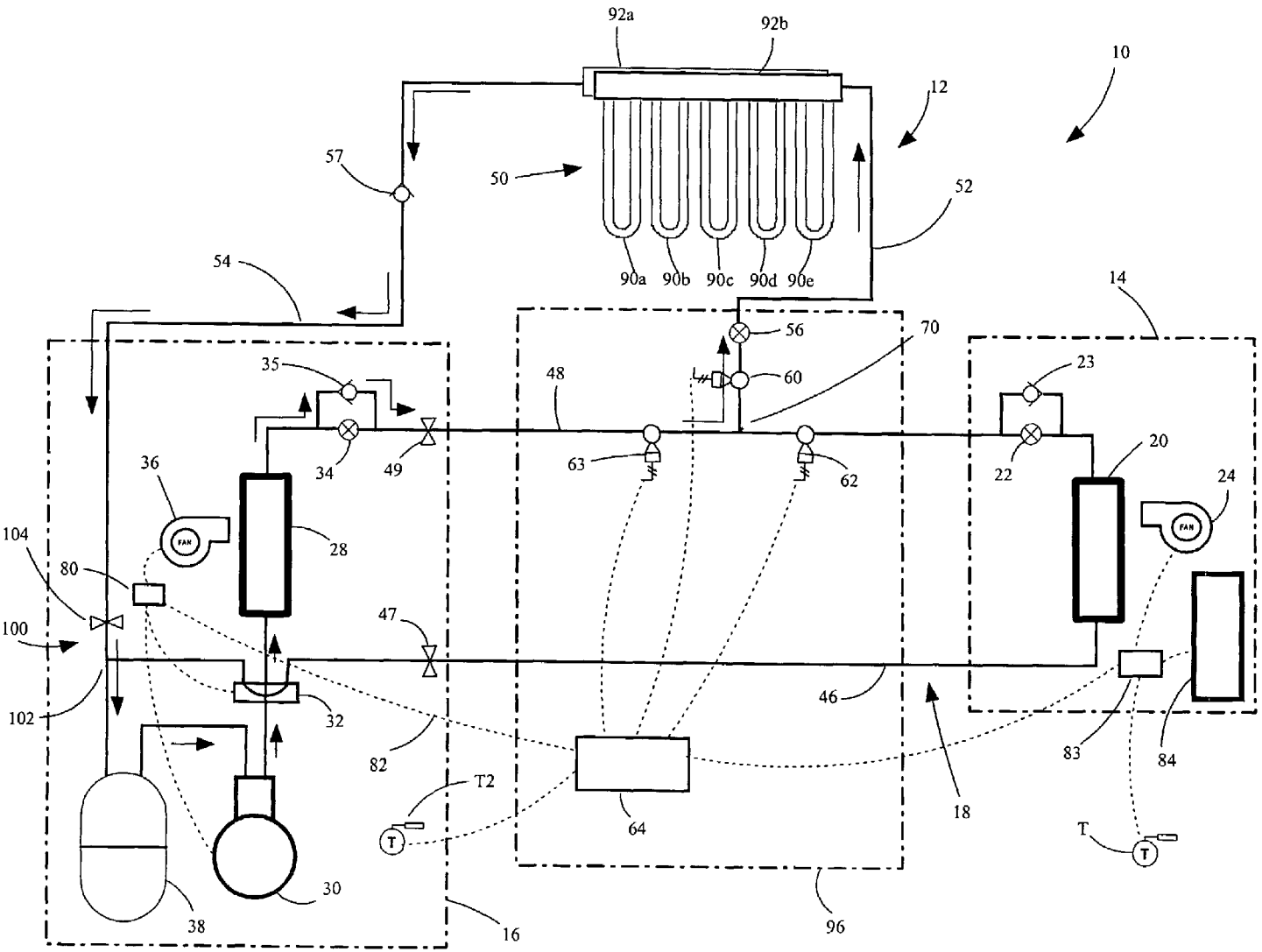
FIG. 5 is a schematic diagram of a heat pump circuit in geothermal defrost mode.

The heat pump system 10 is capable of operation in five separate modes; namely cooling mode (see FIG. 1), air-to-air heating mode (see FIG. 2), geothermal heating mode (see FIG. 3), air-to-air defrost mode (see FIG. 4) and geothermal defrost mode (see FIG. 5). The air-to-air defrost mode may be of limited applicability in many applications and therefore may not be included in all systems. In this embodiment, operation of the system 10 is controlled primarily by an indoor thermostat T, the outdoor controller 80 and the control mechanism 64. In general, the thermostat T controls the indoor air coil unit 14, the outdoor air coil 16 and auxiliary heat source 84. In general, input from the thermostat T or outdoor controller 80 directly or indirectly dictates the position of the reversing valve 32 (or other flow control valve) causing it to be switched between heating and cooling positions as appropriate. The outdoor controller 80 also controls operation of the outdoor fan 36 by turning it on an off as appropriate. In this embodiment, the control mechanism 64 controls operation of the solenoid valves 60, 62 and 63 based on signals received from the outdoor controller 80 and the thermostat T. As noted above, the system 10 may alternatively include a controller (not shown) integrated into the outdoor air coil unit 16 to control operation of the reversing valve 32 or other flow controller and the outdoor fan 36 in a conventional manner. In the cooling mode (or air-to-air air conditioning), the thermostat T sends a signal that places the reversing valve 32 in the cooling position so that refrigerant flows from the gas refrigerant line 46 through the accumulator 38 and the compressor 30 to the outdoor air coil 28. The control mechanism 64 opens solenoid valves 62 and 63, and closes solenoid valve 60. In the outdoor air coil 28, the compressed hot gas refrigerant condenses into a high pressure liquid thereby releasing heat energy into the outdoor air. The transfer of heat is expedited by the outdoor fan 36 which moves air over the outdoor air coil 28. The liquid refrigerant flows from the outdoor air coil 28 into the liquid refrigerant line 48. The liquid refrigerant flows through the bypass valve of the expansion device 34. Because solenoid valve 60 is closed, refrigerant does not flow to the geothermal heat exchanger 50. Instead, the refrigerant flows through open solenoid valves 62 and 63 and eventually through expansion device 22. The expansion device 22 meters the refrigerant to separate the high pressure side of the circuit from the low pressure side of the circuit. The liquid refrigerant flows through the expansion device 22 into the indoor air coil 20. In the indoor air coil 20, the liquid refrigerant evaporates into a gas, thereby abstracting heat from the indoor air. From the indoor air coil 20, the low pressure gas (or vaporized refrigerant) flows through the gas refrigerant line 46 back to the reversing valve to repeat the cycle. The optional check valve 57 prevents gas refrigerant from flowing into refrigerant line 54.

In the air-to-air heating mode, the cycle is essentially reversed. The thermostat T sends a signal that places the reversing valve 32 in the air-to-air heating position so that refrigerant flows from the outdoor air coil 28 through the accumulator 38 and the compressor 30 to the gas refrigerant line 46. The control mechanism 64 opens solenoid valves 62 and 63, and closes solenoid valve 60 (if the valves are not already in those positions). The compressed hot gas refrigerant flows from the reversing valve 32 through the gas refrigerant line 46 to the indoor air coil 20. In the indoor air coil 20, the compressed hot gas refrigerant condenses into a high pressure liquid, thereby releasing heat energy into the indoor air. The transfer of heat is expedited by the indoor blower 24 which moves air over the indoor air coil 20. The liquid refrigerant flows from the indoor air coil 20 into the liquid refrigerant line 48. The liquid refrigerant flows through the bypass valve 23 of the expansion device 22. Because solenoid valve 60 is closed, refrigerant does not flow to geothermal heat exchanger 50. Instead, the refrigerant flows through the open solenoid valves 62 and 63, the expansion device 34, which meters the refrigerant to separate the high pressure side of the circuit from the lower pressure side of the circuit, and eventually to the outdoor air coil 28. In the outdoor air coil 28, the liquid refrigerant evaporates into a gas, thereby abstracting heat from the outdoor air. From the outdoor air coil 28, the low pressure gas (or vaporized) refrigerant flows back to the reversing valve 32 to repeat the cycle. The optional check valve 57 prevents gas refrigerant from flowing into refrigerant line 54.

In the geothermal heating mode, heat is abstracted from the geothermal heat source rather than the outdoor air. The thermostat T places the reversing valve 32 in the heating position so that refrigerant flows from the geothermal heat exchanger 50 through the accumulator 38 and the compressor 30 to the gas refrigerant line 46. The control mechanism 64 opens solenoid valves 60 and 62, and closes solenoid valve 63 (if the valves are not already in those positions). The compressed hot gas refrigerant flows from the reversing valve 32 through the gas refrigerant line 46 to the indoor air coil 20. In the indoor air coil 20, the compressed hot gas refrigerant condenses into a high pressure liquid, thereby releasing heat energy into the indoor air. The transfer of heat is expedited by the indoor blower 24 which moves air over the indoor air coil 20. The liquid refrigerant flows from the indoor air coil 20 into the liquid refrigerant line 48. The liquid refrigerant flows through the bypass of expansion device 22. Because solenoid valve 60 is open and solenoid valve 63 is closed, refrigerant does not flow to the outdoor air coil 28. Instead, the refrigerant flows through the open solenoid valves 62 and 60, the expansion device 56, which meters the refrigerant to separate the high pressure side of the circuit from the lower pressure side of the circuit, and eventually to the distribution manifold 92*a* of the heat exchanger 50. From the distribution manifold 92*a*, the refrigerant flows in parallel through the various loops 90*a–e*. In the loops 90*a–e*, the refrigerant evaporates into a gas, thereby abstracting heat from the geothermal heat source. The vaporized refrigerant flows from the loops 90*a–e* into the output manifold 92*b* and then into refrigerant line 54. From refrigerant line 54, the low pressure gas (or vaporized) refrigerant flows back to the accumulator 38, the compressor 30 and the reversing valve 32 to repeat the cycle.

As described in the Background, frost may accumulate on the outdoor air coil 28 when the system 10 is operating in the air-to-air heating mode and the exterior temperature is near freezing (e.g. between approximately 25 and 37 degrees Fahrenheit). The system 10 is designed to use heat energy from the indoor air or from a geothermal heat source to defrost the outdoor air coil 28. The system 10 may include a timing circuit that causes the system 10 to enter into the defrost mode approximately every 60 minutes when both the system 10 is in the heating mode and the outdoor temperature falls within the frost range (e.g. 25 degrees to 37 degrees Fahrenheit). Alternatively, other conventional methods can be used for determining when the system should enter into the defrost mode. In a typical outdoor air coil unit 16, there will be an outdoor controller 80 that determines, among other things, when to enter and leave the defrost mode. The outdoor controller 80 will typically have a defrost control line 82 for sending a signal to the indoor unit 14 to direct the indoor unit 14 to turn on the auxiliary heat source 84, which may, for example, be a gas furnace or electrical resistance heater. In one embodiment, the defrost control line 82 is routed through the control mechanism 64. When the control mechanism 64 recognizes a signal indicating that the outdoor air coil unit 16 is to enter the defrost mode, the control mechanism 64 can take appropriate action. In the geothermal defrost mode, the control mechanism 64 will use the geothermal subcircuit 12 as a heat source for defrosting the outdoor air coil unit 16. Accordingly, the control mechanism 64 will close solenoid valve 62 and opens solenoid valves 60 and 63. Also, the reversing valve 32 is moved into the cooling position by the outdoor controller 80. Accordingly, refrigerant flows from the gas refrigerant line 54 through the accumulator 38 and the compressor 30 to the outdoor air coil 28. In the outdoor air coil 28, the compressed hot gas refrigerant condenses into a high pressure liquid, thereby releasing heat energy into the outdoor air coil. This heat energy functions to melt away any frost collected on the outdoor air coil 28. The outdoor fan 36 is typically turned off by the outdoor controller 80 during the defrost mode. The liquid refrigerant flows from the outdoor air coil 28 into the liquid refrigerant line 48. The liquid refrigerant flows through the bypass valve 35 of the expansion device 34. Because solenoid valve 62 is closed, refrigerant does not flow to the indoor air coil 20. Instead, the refrigerant flows through refrigerant line 52, which includes opened solenoid valve 60 and expansion device 56. The expansion device 56 meters the refrigerant to separate the high pressure side of the circuit from the low pressure side of the circuit. The liquid refrigerant flows through the expansion device 56 into the distribution manifold 92*a* of the heat exchanger 50. From the distribution manifold 92*a*, the refrigerant flows in parallel through the various loops 90*a–e*. In the loops 90*a–e*, the refrigerant evaporates into a gas, thereby abstracting heat from the geothermal heat source. The vaporized refrigerant flows from the loops 90*a–e* into the output manifold 92*b* and then into refrigerant line 54. From refrigerant line 54, the refrigerant returns to the accumulator 38, the compressor 30 and then the reversing valve 32, after which it repeats the cycle.

In the air-to-air defrost mode, the system 10 is designed to use indoor air as the heat source for defrosting the outdoor air coil unit 16. In this mode, the defrost controller 80 sends a defrost signal on defrost control line 82 and moves the reversing valve 32 into the cooling position. The control mechanism 64 intercepts the signal. In response, the control mechanism 64 closes solenoid valve 60 and opens solenoid valves 62 and 63. Accordingly, refrigerant flows from the gas refrigerant line 46 through the reversing valve 32, the accumulator 38 and the compressor 30 to the outdoor air coil 28. In the outdoor air coil 28, the compressed hot gas refrigerant condenses into a high pressure liquid, thereby releasing heat energy into the outdoor air coil. This heat energy functions to melt away any frost collected on the outdoor air coil 28. The outdoor fan 36 is typically turned off by the outdoor controller 80 during the defrost mode. The liquid refrigerant flows from the outdoor air coil 28 into the liquid refrigerant line 48. The liquid refrigerant flows through the bypass valve 35 of the expansion device 34. Because solenoid valve 60 is closed, refrigerant does not flow to the geothermal heat exchanger 50. Instead, the refrigerant flows through expansion device 22, which meters the refrigerant to separate the high pressure side of the circuit from the low pressure side of the circuit, and into the indoor air coil 20. In the indoor air coil 20, the refrigerant evaporates into a gas, thereby abstracting heat from the indoor air. The vaporized refrigerant flows into gas refrigerant line 46. From refrigerant line 46, the refrigerant returns to the reversing valve 32, the accumulator 38, the compressor 30 and then back through the reversing valve 32, after which it repeats the cycle. The air-to-air defrost mode is very similar in operation to the air-to-air air conditioning mode and will result in heat being abstracted from the indoor air. To address the problems associated with cold indoor air, the control mechanism 64 may also forward the defrost control signal to the indoor air unit 12 so that the auxiliary hear source 84 may be engaged to counteract the cold air in a generally conventional manner.

The system 10 may remain in the defrost mode for a predetermined period of time, which will vary from application depending on the estimated amount of time needed to defrost the circuit. In the illustrated embodiment, the system 10 will remain in the defrost mode for approximately ten minutes. However, the length of the defrost cycle will vary from application to application.

As can been seen, the system 10 isolates one of the heat exchange devices (e.g. the outdoor air coil, indoor heat exchanger or geothermal heat exchanger) from the others in each mode of operation. Given that the various heat exchange devices have different refrigerant capacities, the isolation of a particular heat exchange device can result in refrigerant imbalance. To address this problem in the system 10, the circuit may be configured (as it is in the illustrated embodiment) so that the isolated heat exchange device is always operatively connected to the low pressure side of the compressor 30. As a result, the system 10 automatically "pumps down" or draws refrigerant out of the isolated heat exchange device. The system 10 may also include a receiver (not shown) or other conventional refrigerant storage device to further address issues of refrigerant imbalance.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A heat and cooling system comprising:
an indoor heat exchanger;
an outdoor heat exchanger;
a geothermal heat exchanger;
a plurality of refrigerant lines interconnecting said indoor heat exchanger, said outdoor coil and said geothermal heat exchanger; and
a control circuit for selectively moving the system between a first heating mode in which refrigerant cycles between said indoor heat exchanger and said outdoor heat exchanger, a cooling mode in which refrigerant cycles between said indoor heat exchanger and said outdoor heat exchanger, a second heating mode in which refrigerant cycles between said geothermal heat exchanger and said indoor heat exchanger, a defrost mode in which refrigerant cycles between said outdoor heat exchanger and said geothermal heat exchanger means.

2. The system of claim 1 wherein said plurality of refrigerant lines includes a liquid refrigerant line interconnecting said outdoor heat exchanger with said indoor heat exchanger; and
further comprising a first refrigerant line interconnecting said geothermal heat exchanger means with said liquid refrigerant line.

3. The system of claim 2 further comprising a compressor for circulating refrigerant through the system, said compressor having a low pressure side and a high pressure side; and
further comprising a second refrigerant line interconnecting said geothermal heat exchanger means with said low pressure side of said compressor.

4. The heat pump of claim 3 wherein said control circuit includes:
a first valve located in said first refrigerant line;
a second valve located in said liquid refrigerant line between said indoor heat exchanger and said first refrigerant line;
a third valve located in said liquid refrigerant line between said outdoor coil and said first refrigerant line; and
a valve control for selectively opening and closing said first valve, said second valve and said third valve.

5. The heat pump of claim 4 wherein said indoor heat exchanger is further defined as an indoor air coil.

6. The heat pump of claim 5 wherein said control circuit includes means for isolating only one of said indoor heat exchanger, said outdoor heat exchanger and said geothermal heat exchanger during each mode of operation, said circuit configured with said isolated one of said indoor heat exchanger, said outdoor heat exchanger and said geothermal heat exchanger being connected to a low pressure side of said compressor during each of said modes.

7. The heat pump of claim 6 wherein said control circuit includes a reversing valve for varying a direction of flow of refrigerant.

8. The heat pump of claim 7 wherein said control circuit includes an expansion device on said first refrigerant line and a check valve on said second refrigerant line, said check valve preventing flow of refrigerant toward said geothermal heat exchanger along said second refrigerant line.

9. An apparatus comprising:
a heat pump including:
an indoor heat exchanger;
an outdoor coil;
heat pump refrigerant lines interconnecting said indoor heat exchanger and said outdoor coil;
a compressor adapted to cycle a refrigerant between said indoor heat exchanger and said outdoor coil through said refrigerant lines;
a refrigerant flow control valve for controlling a direction of flow of refrigerant through said heat pump;
a geothermal subcircuit including:
a geothermal heat exchanger means for abstracting heat from a geothermal heat source;
geothermal subcircuit refrigerant lines connecting said geothermal heat exchanger means with said outdoor coil in parallel with said indoor heat exchanger and to said indoor heat exchanger in parallel with said outdoor coil;
a plurality of valves disposed in said heat pump refrigerant lines and said geothermal heat exchanger refrigerant lines; and a control for controlling operation of said flow control valve and said plurality of valves to move the apparatus between an air-to-air heating mode, an air-to-air cooling mode, a geothermal heating mode and a geothermal defrost mode.

10. The apparatus of claim 9 wherein said heat pump refrigerant lines includes a gas refrigerant line and a liquid refrigerant line; and said geothermal subcircuit refrigerant lines includes a first refrigerant line connecting said geothermal heat exchanger means with said liquid refrigerant line.

11. The apparatus of claim 10 wherein said geothermal subcircuit refrigerant lines includes a second refrigerant line connecting said geothermal heat exchanger with said compressor.

12. The apparatus of claim 11 further comprising a first expansion device installed in said first refrigerant line, a second expansion device installed in said liquid refrigerant line between said first refrigerant line and said indoor heat exchanger, and a third expansion device installed in said liquid refrigerant line between said first refrigerant line and said outdoor coil.

13. The apparatus of claim 12 wherein said plurality of valves includes a first valve installed in said liquid refrigerant line between said indoor heat exchanger and said first refrigerant line, a second valve installed in said first refrigerant line, and a third valve installed in said liquid refrigerant line between said outdoor coil and said first refrigerant line.

14. A heat pump apparatus comprising:

a circuit;

refrigerant contained within said circuit, said refrigerant adapted to cycle through said circuit;

an indoor heat exchanger included within said circuit and adapted to transfer heat between said refrigerant and indoor air;

an outdoor heat exchanger included within said circuit and adapted to transfer heat between said refrigerant and outdoor air;

a geothermal subcircuit included within said circuit and adapted to transfer heat from a geothermal heat source into said refrigerant; and a control for selectively moving refrigerant through said circuit in an air-to-air heating mode in which said refrigerant is cycled through said outdoor heat exchanger and said indoor heat exchanger to abstract heat from the outdoor air and to release heat into the indoor air, an air-to-air cooling mode in which said refrigerant is cycled through said indoor heat exchanger and said outdoor heat exchanger to abstract heat from the indoor air and release heat into the outdoor air, a geothermal heating mode in which said refrigerant is cycled through said indoor heat exchanger and said geothermal subcircuit to abstract heat from the geothermal heat source and release it into the indoor air and a geothermal defrost mode in which said refrigerant is cycled through said geothermal subcircuit and said outdoor coil to abstract heat from the geothermal heat source and release heat into the outdoor air.

15. The apparatus of claim 14 further comprising a plurality of refrigerant lines interconnecting said indoor heat exchanger, said outdoor heat exchanger, and said geothermal subcircuit; and wherein said control includes a plurality of valves for selectively closing selected refrigerant lines and a reversing valve for selectively controlling a direction of flow of said refrigerant through said circuit.

16. The apparatus of claim 15 wherein said plurality of refrigerant lines including a gas refrigerant line connected between said indoor heat exchanger and said outdoor coil, and a liquid refrigerant line connected between said indoor heat exchanger and said outdoor coil; and wherein said geothermal subcircuit includes a first refrigerant line connecting said geothermal subcircuit with said liquid refrigerant line.

17. The apparatus of claim 16 wherein said circuit includes a compressor, said geothermal subcircuit including a second refrigerant line connecting said geothermal subcircuit with said compressor.

18. The apparatus of claim 17 wherein said plurality of valves includes a first valve installed in said liquid refrigerant line between said indoor heat exchanger and said first refrigerant line, a second valve installed in said first refrigerant line, and a third valve installed in said liquid refrigerant line between said outdoor coil and said first refrigerant line.

19. The apparatus of claim 18 further comprising a first expansion device installed in said first refrigerant line, a second expansion device installed in said liquid refrigerant line between said first refrigerant line and said indoor heat exchanger, and a third expansion device installed in said liquid refrigerant line between said first refrigerant line and said outdoor coil.

20. The apparatus of claim 17 wherein said compressor includes a low pressure side and a high pressure side, said second refrigerant line connecting said geothermal subcircuit to said low pressure side of said compressor.

21. The apparatus of claim 20 wherein said circuit further includes:

a first one-way bypass circuit connecting in parallel with said second expansion device;

a second one-way bypass circuit connected in parallel with said third expansion device; and a check valve installed in said second refrigerant line to prevent flow of refrigerant from said compressor to said geothermal subcircuit.

22. The apparatus of claim 14 wherein said control includes means for isolating only one of said indoor heat exchanger, said outdoor heat exchanger and said geothermal heat exchanger during each mode of operation, said circuit configured with said isolated one of said indoor heat exchanger, said outdoor heat exchanger and said geothermal heat exchanger being connected to a low pressure side of said compressor during each of said modes, whereby refrigerant is automatically drawn out of said isolated one of said indoor heat exchanger, said outdoor heat exchanger and said geothermal heat exchanger.

23. An air source heat pump unit comprising:

a heat exchanger;

a refrigerant control valve;

a compressor having a low pressure side and a high pressure side;

a refrigerant line interconnecting said refrigerant control valve and said low pressure side of said compressor; and a geothermal upgrade port mounted in said refrigerant line between said refrigerant control valve and said low pressure side of said compressor, said geothermal port including a full capacity refrigerant port and a valve selectively opening and closing said full capacity refrigerant port.

24. The air source heat pump of claim 23 wherein said full capacity refrigerant port is further defined as a splitter being at least one of a T-fitting and a Y-fitting and wherein said valve is further defined as a manually operated valve.

25. The air source heat pump of claim 24 further comprising an accumulator, said full capacity refrigerant port being mounted along said refrigerant line between said refrigerant control valve and said accumulator.

26. The air source heat pump of claim 25 wherein said heat exchanger, said compressor, said refrigerant control valve and said accumulator are contained within a common housing; and wherein said full capacity refrigerant port is accessible from an exterior of said housing.

* * * * *